US006120318A

United States Patent [19]

Reed et al.

[11] Patent Number: 6,120,318

[45] Date of Patent: Sep. 19, 2000

[54] STACKED ELECTRICAL CONNECTOR HAVING VISUAL INDICATOR SUBASSEMBLY

[75] Inventors: Carl G. Reed, Clemmons; Victor E. Slack, Lewisville, both of N.C.

[73] Assignee: The Whitaker Corporation, Wilmington, Del.

[21] Appl. No.: 09/237,109

[22] Filed: Jan. 26, 1999

[51] Int. Cl.[7] ..... H01R 3/00

[52] U.S. Cl. ..... 439/490

[58] Field of Search ..... 439/488, 490, 439/79, 540.1, 541.5, 676

[56] References Cited

U.S. PATENT DOCUMENTS 4,978,317 12/1990 Pocrass ..... 439/490
5,531,612 7/1996 Goodall et al. ..... 439/541.5
5,704,802 1/1998 Loudermilk ..... 439/490
5,957,730 8/1998 Wang ..... 439/490

*Primary Examiner*—Lincoln Donovan
*Assistant Examiner*—Javaid Nasri
*Attorney, Agent, or Firm*—Robert Kapalka

[57] ABSTRACT

An electrical connector includes a housing having cavities that can receive mating electrical connectors. The cavities are arranged as vertically aligned pairs. The housing holds visual indicators which are associated with the cavities. The visual indicators for each vertically aligned pair are arranged in a rectangular array with one visual indicator at each exterior corner of the vertically aligned pair. At least some of the visual indicators have leads which extend along a rear of the housing. These leads are installed in a retainer prior to installation of the visual indicators in the housing. The visual indicators and the retainer form a subassembly which can be installed on the housing as a unit.

9 Claims, 7 Drawing Sheets

STACKED ELECTRICAL CONNECTOR HAVING VISUAL INDICATOR SUBASSEMBLY

FIELD OF THE INVENTION

The invention relates to an electrical connector having a mating face with visual indicators disposed along the mating face, and in particular, to an electrical connector having connector receptacles and visual indicators arranged in upper and lower rows.

BACKGROUND OF THE INVENTION

Electrical connectors known as modular jacks are commonly used in the communications industry. These connectors have receptacles that receive mating modular plugs to permit transfer of voice and/or data signals between different pieces of equipment.

U.S. Pat. No. 4,978,317 discloses a modular jack having visual indicators such as light-emitting diodes (LED's) that signal a status of a connection between two pieces of equipment.

U.S. Pat. No. 5,531,612 discloses a modular jack assembly which is commonly known as a stacked modular jack. The assembly includes a plurality of modular jacks arranged in upper and lower horizontal rows.

U.S. Pat. No. 5,704,802 discloses a stacked modular jack having visual indicators which are associated with each of the individual modular jacks. The visual indicators are packaged as subassemblies each of which resides above a vertical pair of modular jacks in the upper and lower rows.

There is a need to reduce the size of a stacked modular jack having visual indicators. There is also a need to simplify assembly and reduce manufacturing cost of a stacked modular jack having visual indicators.

SUMMARY OF THE INVENTION

An electrical connector according to the invention comprises a dielectric housing having a front face, cavities which are open through the front face, and contacts which are disposed in the cavities. Visual indicators are disposed along the front face and are associated with the cavities. The visual indicators have electrical leads that include rearwardly extending portions and downwardly extending portions. A retainer is secured to the housing and disposed along a rear of the housing. The retainer has apertures and the downwardly extending portions of the leads are disposed in the apertures. The downwardly extending portions of the leads are installed in the apertures prior to installation of the retainer on the housing, whereby the visual indicators and the retainer comprise a subassembly which is installed on the housing unit.

BRIEF DESCRIPTION OF THE DRAWINGS

The invention will now be described by way of example with reference to the accompanying drawings wherein.

DETAILED DESCRIPTION OF A PREFERRED EMBODIMENT

Figure 1:
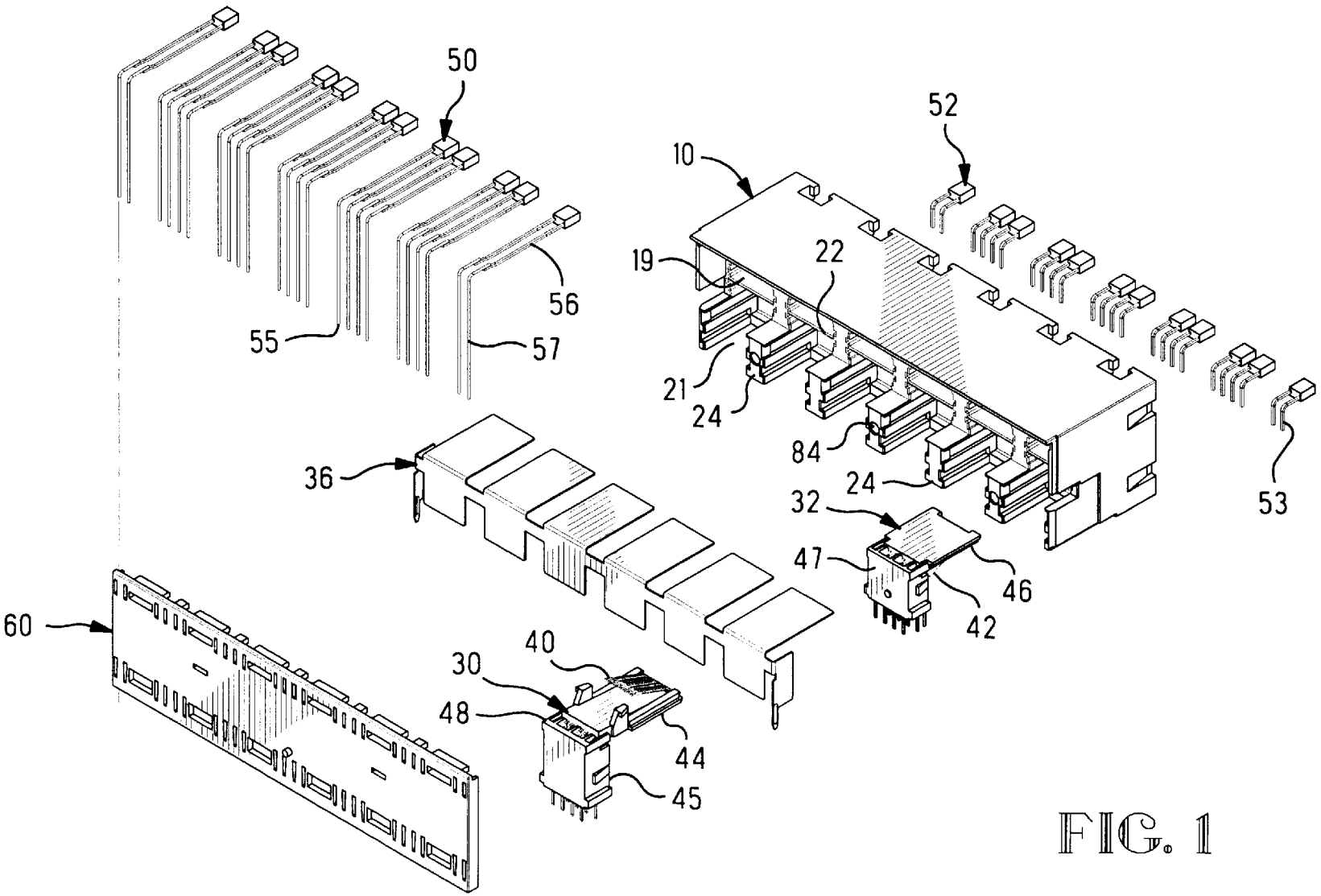
FIG. 1 is an exploded isometric view of an electrical connector according to the invention.

As shown in FIGS. 1–4, an electrical connector according to the invention comprises a dielectric housing 10 having a front face 11, a top wall 12, side walls 13, and a bottom wall 14 which has an exterior mounting face. A plurality of cavities 15, 16 open into the housing through the front face 11. Each of the cavities 15, 16 is configured to receive a mating modular plug (not shown), and each of the cavities has a notch 17 which can receive a latch of the mating modular plug. However, it should be understood that the invention may be embodied in an electrical connector having cavities which are configured to receive one or more different kinds of mating connectors.

The cavities 15, 16 are arranged in upper and lower rows with the cavities 15 being termed upper cavities and the cavities 16 being termed lower cavities. Each of the upper cavities 15 is associated with a pair of passageways 58 in the housing, and each of the lower cavities 16 is associated with a pair of passageways 59 in the housing. Each pair of passageways 58, 59 is disposed at exterior corners of its associated cavity 15, 16 as viewed from the front of the housing 10.

Figure 2:
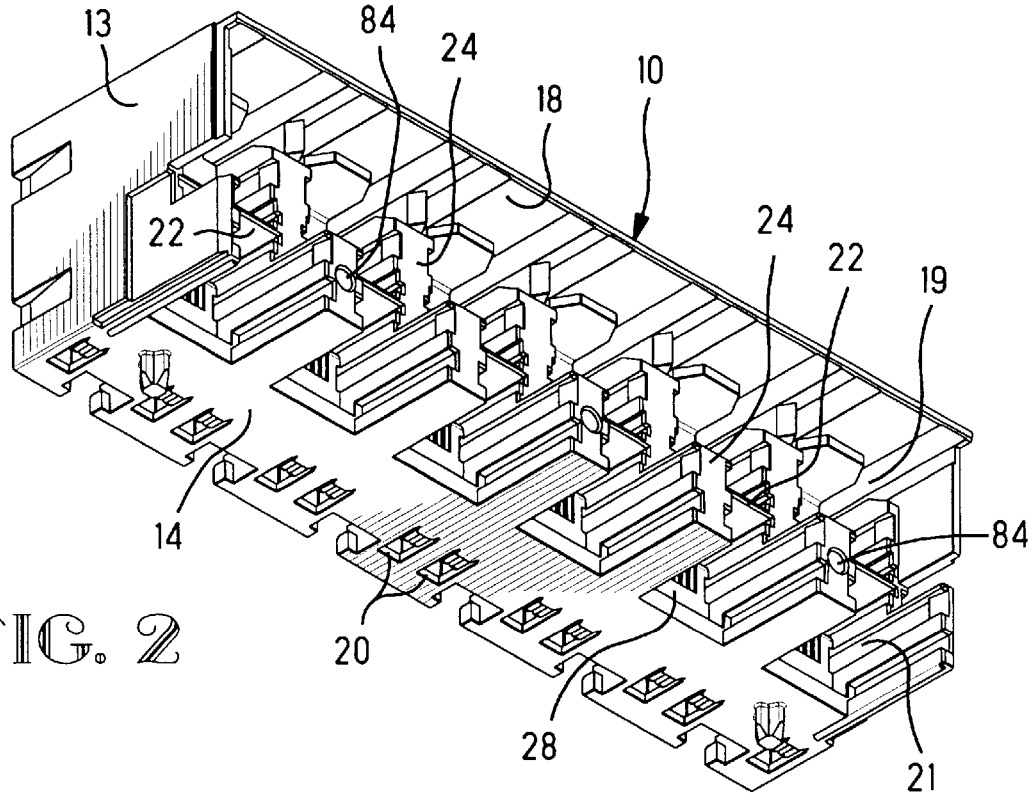
FIG. 2 is a bottom rear isometric view of a housing used in the connector.
Figure 3:
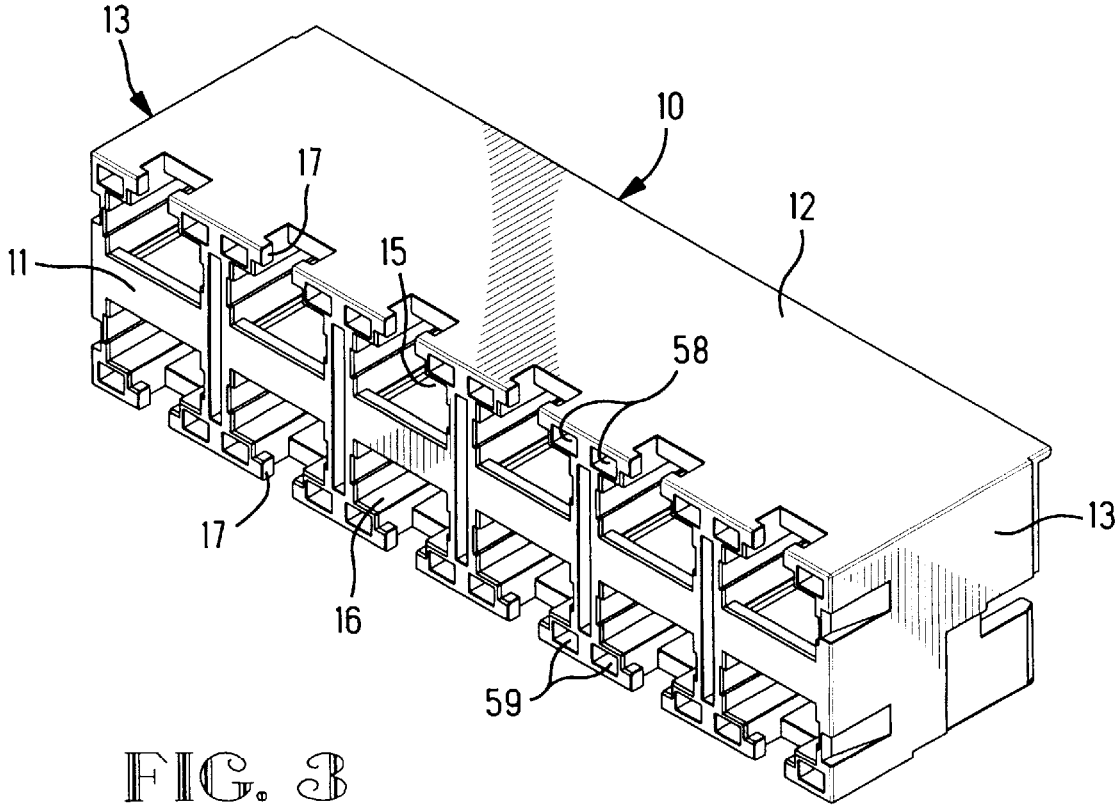
FIG. 3 is a top front isometric view of the housing.
Figure 4:
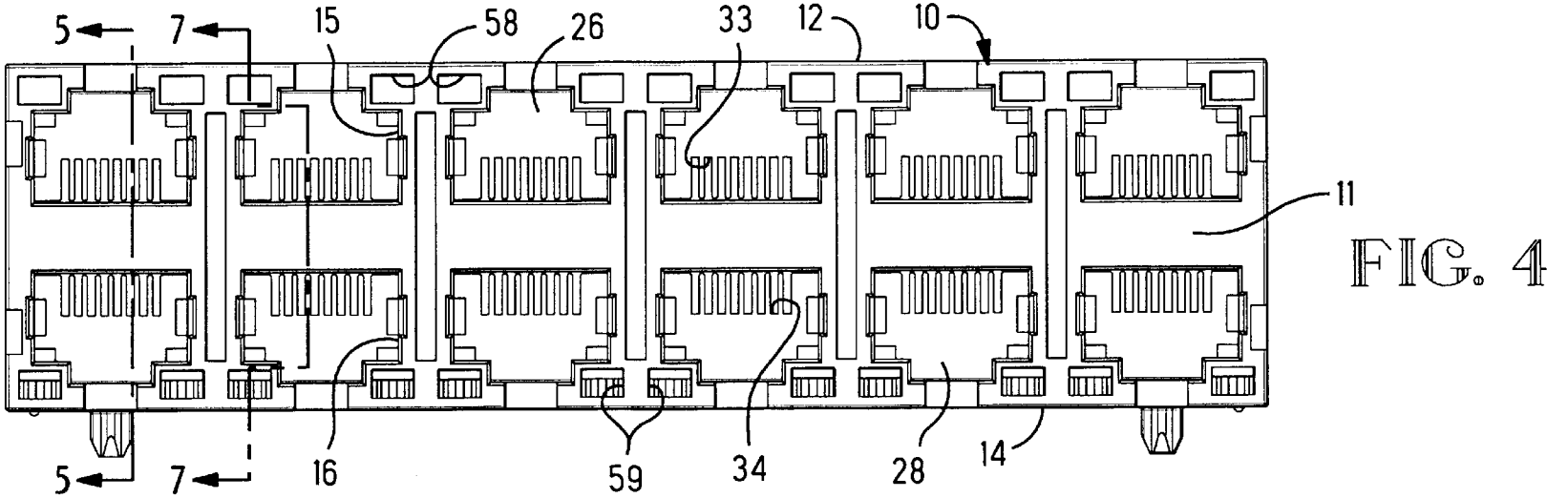
FIG. 4 is a front elevation view of the housing.
Figure 5:
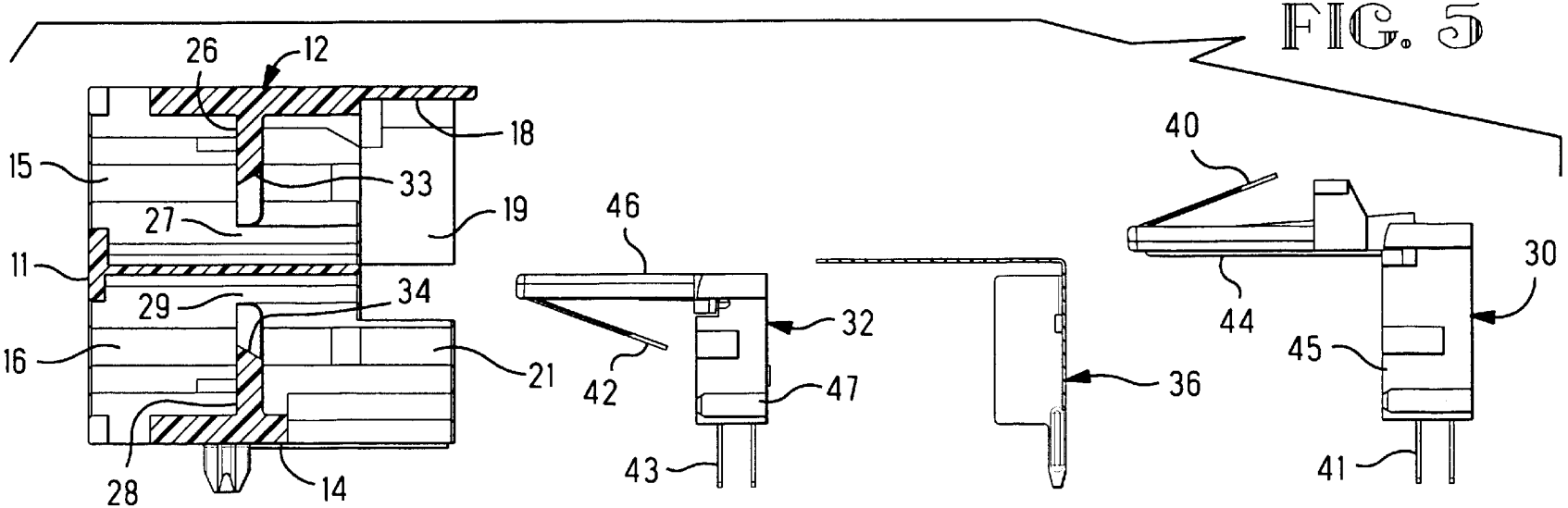
FIG. 5 is a cross-sectional view of the housing taken along line 5—5 of FIG. 4, and also showing terminal inserts and an inner shield poised for installation in the housing.

As shown in FIGS. 2, 4 and 5, in its interior the housing has a horizontal divider wall 22 between the upper and lower cavities 15, 16, and vertical divider walls 24 which separate the cavities into vertically aligned pairs each including one upper cavity 15 and one lower cavity 16. The housing also has upper and lower mid-walls 26, 28 which extend into the housing from respective ones of the top and bottom walls 12, 14. The upper and lower mid-walls 26, 28 partially enclose the upper and lower cavities 15, 16 at a rear of each cavity. Ends of the upper and lower mid-walls 26, 28 are spaced from the horizontal divider walls 22 to create gaps 27, 29. Each of the upper and lower mid-walls has a series of slots 33, 34 in its end. The top wall 12 has a rear ledge 18 which overhangs upper rear entranceways 19 and lower rear entranceways 21. Each of the upper cavities 15 is open to one of the upper rear entranceways 19 through its associated gap 27 and series of slots 33, and each of the lower cavities 16 is open to one of the lower rear entranceways 21 through its associated gap 29 and series of slots 34.

With reference to FIGS. 1 and 5, the housing 10 holds upper and lower terminal inserts 30, 32 (only one of each is shown in FIG. 1) corresponding to the upper and lower cavities 15, 16, respectively. Each of the terminal inserts 30, 32 includes a plurality of electrical conductors which are held in fixed relative positions by a dielectric material. The upper terminal insert 30 has conductors with resilient contact portions 40 and circuit board mounting portions 41 which are held by a dielectric material having a horizontal portion 44 and a vertical portion 45. The lower terminal insert 32 has conductors with resilient contact portions 42 and circuit board mounting portions 43 which are held by a dielectric material having a horizontal portion 46 and a vertical portion 47.

Figure 6:
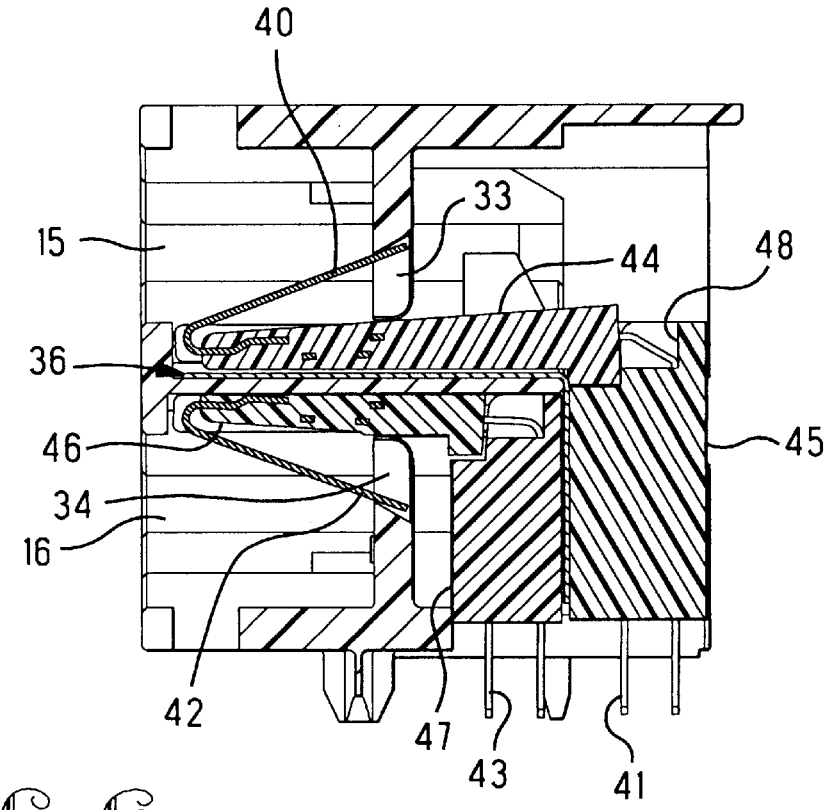
FIG. 6 is a cross-sectional view corresponding to FIG. 5 showing the terminal inserts and inner shield installed in the housing.
Figure 7:
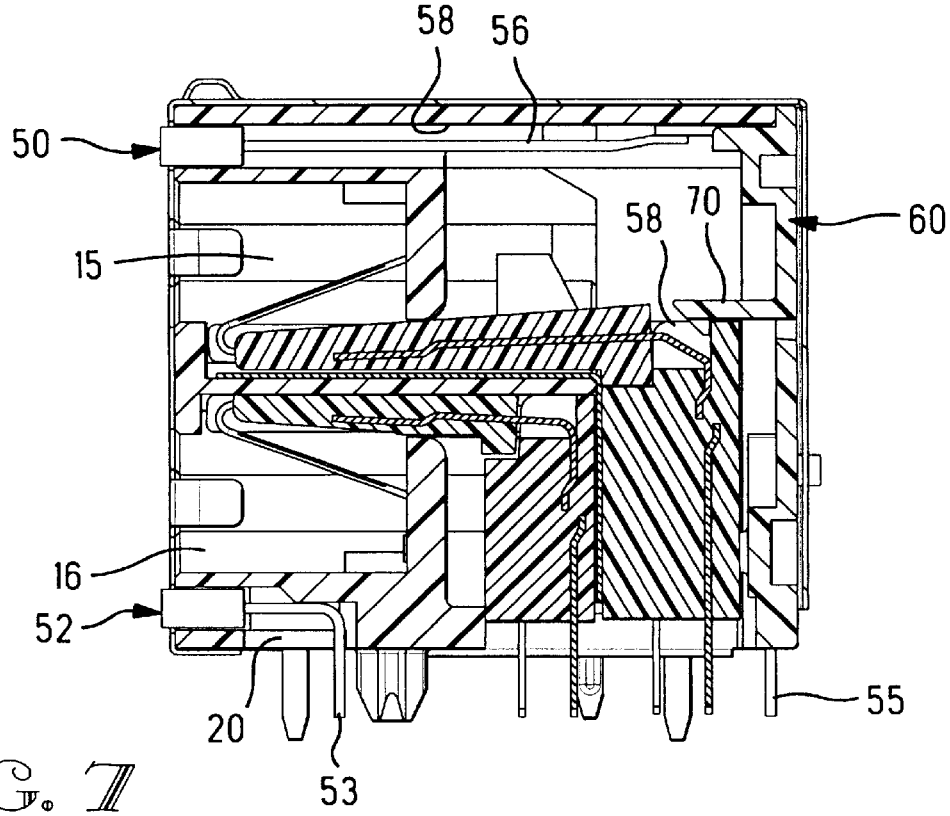
FIG. 7 is a cross-sectional view taken along line 7—7 of FIG. 4 showing components of an electrical connector in assembled condition in the housing.
Figure 8:
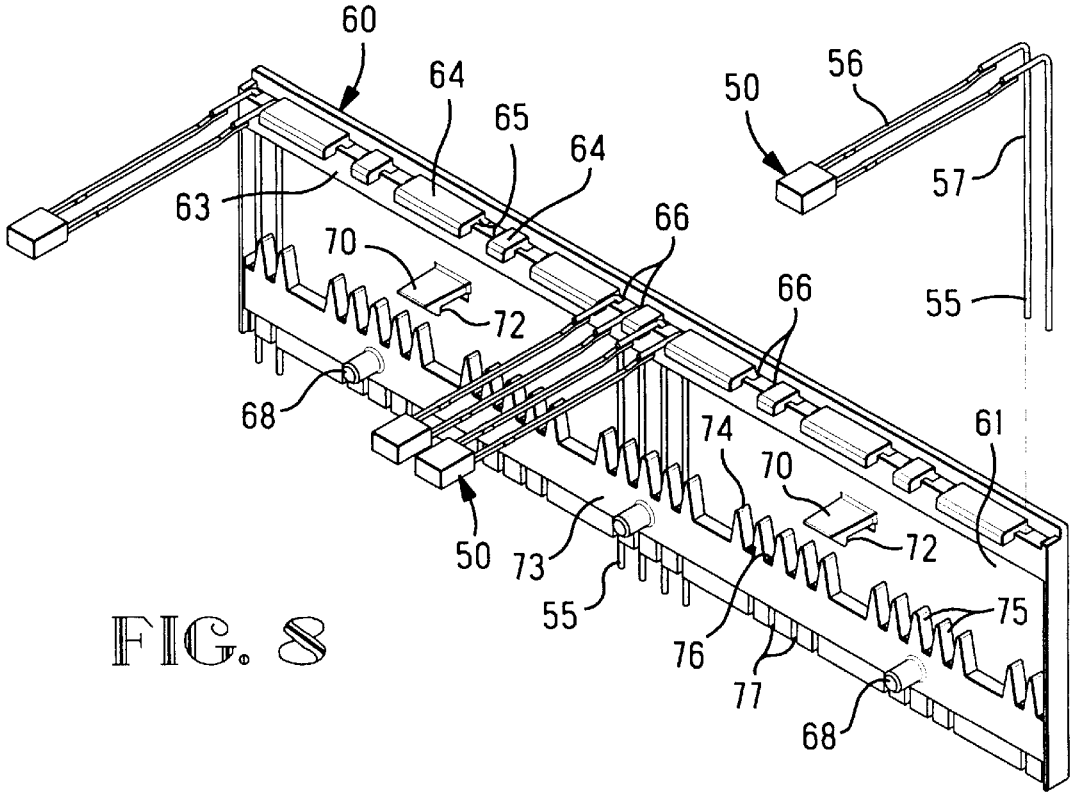
FIG. 8 is a front isometric view of a retainer and visual indicator subassembly which can be attached to the housing.
Figure 9:
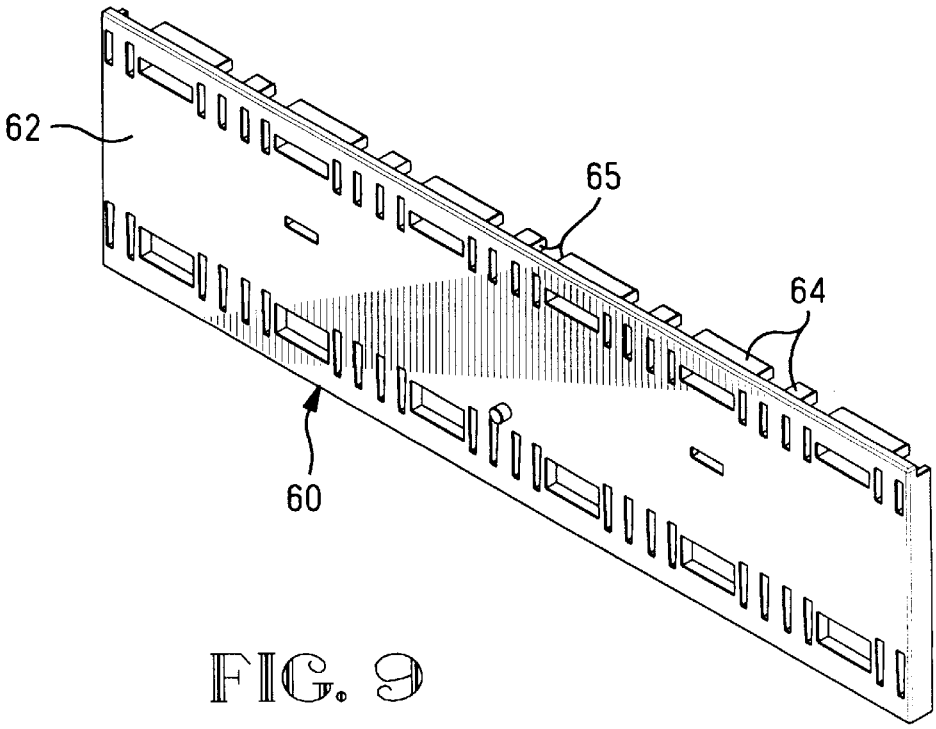
FIG. 9 is a rear isometric view of the retainer.
Figure 12:
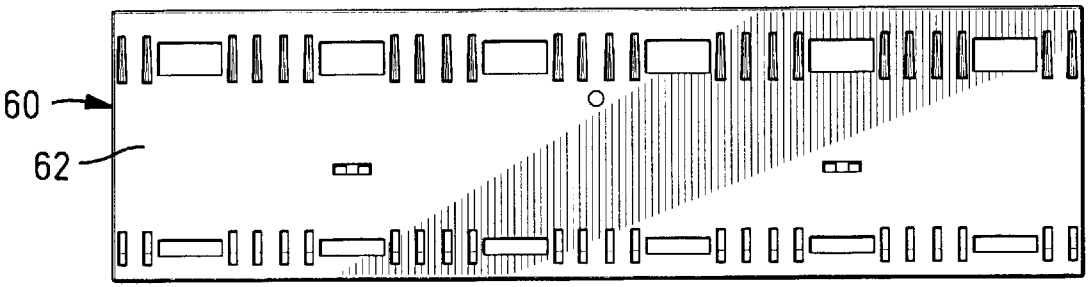
FIG. 12 is a rear view of the retainer.
Figure 11:
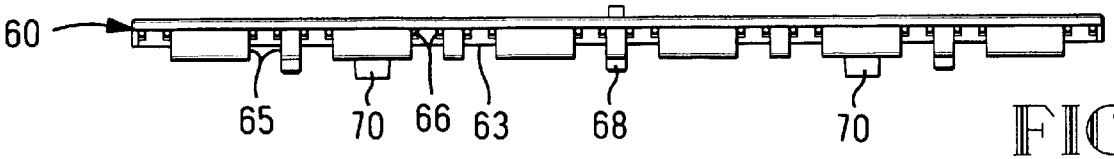
FIG. 11 is a top view of the retainer.
Figure 10:
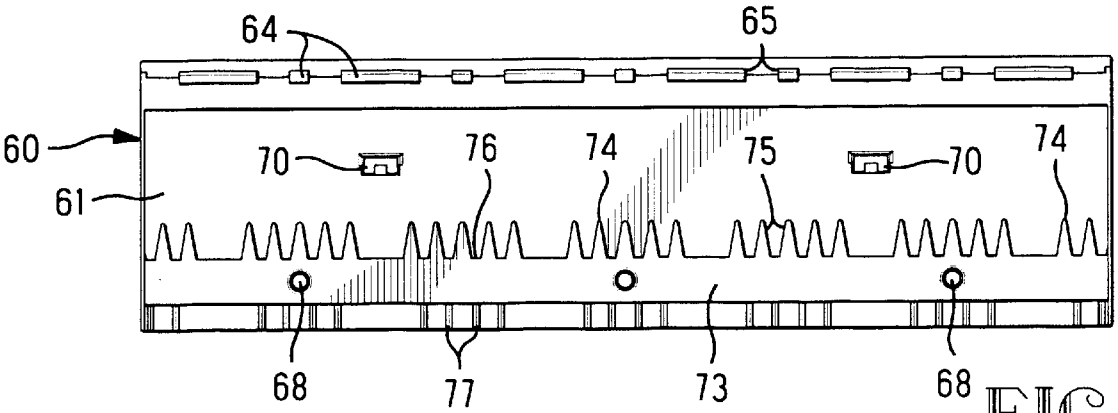
FIG. 10 is a front elevation view of the retainer.
Figure 13:
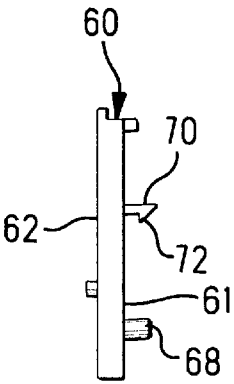
FIG. 13 is a side view of the retainer.

The terminal inserts 30, 32 are installed into the housing through the entranceways 19, 21 at the rear of the housing. The lower terminal inserts 32 are installed first, followed by an internal shield 36 made of sheet metal, followed by the upper terminal inserts 30. The horizontal portions 44, 46 of the upper and lower terminal inserts are installed through the gaps 27, 29 between the mid-walls 26, 28 and the horizontal divider wall 22. During the installation, the resilient contact portions 40, 42 enter and partially pass through the slots 33, 34 in the mid-walls. Upon full insertion of the terminal inserts, the resilient contact portions 40, 42 are exposed in the cavities 15, 16 while ends of the resilient contact portions reside in the slots 33, 34, as shown in FIG. 6. The slots serve to maintain the resilient contact portions in alignment and to prevent shorting between adjacent resilient contact portions.

With reference to FIGS. 1–3 and 7, the housing 10 holds visual indicators such as light-emitting diodes (LED's) which are exposed along the front face 11 of the housing. The visual indicators are arranged as upper visual indicators 50 which are associated with the upper cavities 15, and lower visual indicators 52 which are associated with the lower cavities 16. Each of the cavities 15, 16 has an associated pair of visual indicators 50, 52 disposed in its associated passageways 58, 59.

The lower visual indicators 52 are individually installed from the front of the housing 10 into the passageways 59. The lower visual indicators have leads 53 which exit through pockets 20 in the bottom wall 14 of the housing. The lower visual indicators 52 are secured in the passageways 59 by an interference fit.

The upper visual indicators 50 are carried by a retainer 60 to form a subassembly which is installed on the housing 10 as a unit. The retainer 60 provides a back cover for the housing 10 after installation of the subassembly.

With reference also to FIGS. 8–13, the housing back cover or retainer 60 comprises a plate member having a front 61 and a rear 62. A pair of ribs 63 and 73 extend laterally across the front of the plate member. Each of the ribs has a series of apertures 66 and 76 extending vertically therethrough. Each of the apertures 66 is vertically aligned with one of the apertures 76 and with a groove 77.

Along an upper surface of the rib 63 are a series of blocks 64 having side faces 65. Each of the side faces 65 is coplanar with a wall surface of one of the apertures 66.

Along an upper surface of the rib 73 are a series of projections 74 having inclined surfaces 75. Pairs of inclined surfaces 75 on adjacent projections 74 provide funnels leading to the apertures 76 at the base of the projections 74.

The retainer also has positioning posts 68 and latch arms 70 which have latch projections 72.

The upper visual indicators 50 have leads 55 each including a horizontal portion 56 and a vertical portion 57. The leads 55 are inserted downwardly into respective ones of the apertures 65 and further into the apertures 76 and the grooves 77. The side surfaces 65 and the inclined surfaces 75 serve to guide the leads into the apertures 66 and 76, respectively. Preferably, the leads are vertically positioned with respect to the retainer such that a predetermined length of each lead extends below a bottom edge of the retainer. Then, the leads are bent around an upper edge of the rib 63 to form the horizontal portions 56 and the vertical portions 57. The vertical portions of the leads are held in the apertures 66 and 76 with a slip fit.

Alternatively, the visual indicators may be positively secured to the retainer by a number of different devices. For example, the retainer may have forwardly open grooves which are dimensioned to receive the vertical sections of the leads in an interference fit, or the leads may be secured in the grooves by staking or ultrasonic bonding.

The subassembly including the visual indicators 50 and the retainer 60 is installed onto the housing from the rear of the housing. The visual indicators 50 are inserted into the passageways 58 (FIG. 7) above the upper cavities 15. During the installation, the retainer positioning posts 68 are received in holes 84 (FIG. 2) at rear ends of the vertical divider walls 24 of the housing, thereby positioning the retainer on the housing. Upon full installation of the visual indicators 50 through the passageways 58, the latch projections 72 of the latch arms 70 become engaged behind walls of pockets 48 in the upper terminal inserts 30, thereby securing the subassembly to the housing.

An alternative means for securing the subassembly to the housing may be provided by dimensioning the holes 84 to receive the posts 68 with an interference fit. Each of the holes 74 may have a hexagonal cross-sectional shape which receives one of the posts in an interference fit.

Figure 14:
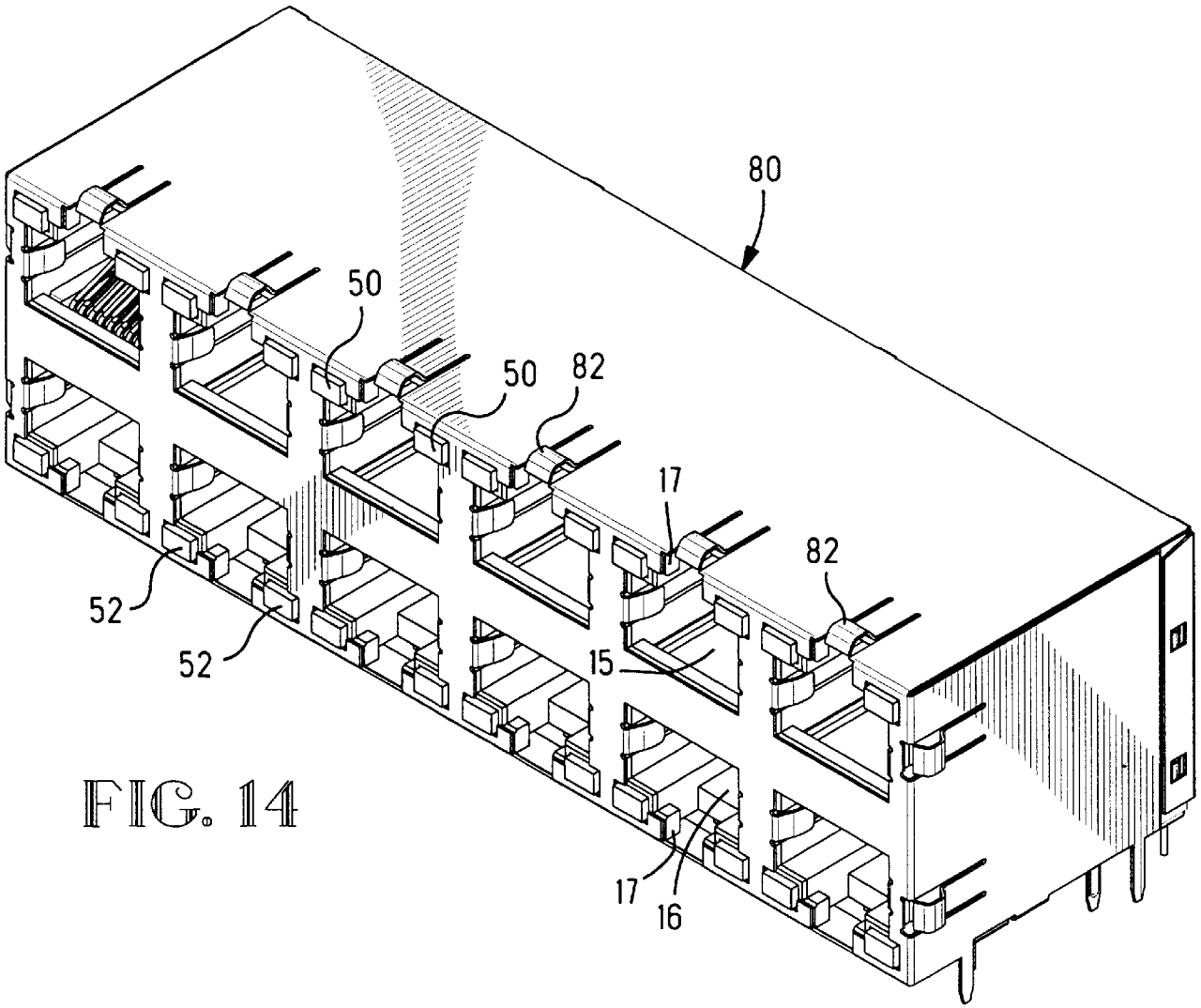
FIG. 14 is a top front isometric view of an electrical connector assembly according to the invention, including an external shield.

A fully assembled electrical connector is shown in FIG. 14. The connector has upper cavities 15 and lower cavities 16 each with a notch 17. Each of the cavities 15, 16 has an associated pair of visual indicators 50, 52. Each pair of visual indicators is disposed on respective opposite sides of the notch of its associated cavity. For each pair of vertically aligned cavities 15 and 16, the associated pairs of visual indicators 50 and 52 are disposed in a rectangular array, with one of the visual indicators at each corner of the rectangular array. This arrangement provides a compact package of stacked modular jacks and visual indicators.

The electrical connector has an external shield 80 in the form of a sheet metal shell which substantially surrounds the housing. The shield has resilient grounding tabs 82 which are engageable with edges of a cutout in a wall panel (not shown). The resilient grounding tabs are vertically aligned with respective ones of the cavities and their notches along the top wall of the housing.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. An electrical connector comprising:

a dielectric housing having a front face and cavities which are open through the front face;

contacts disposed in the cavities;

visual indicators disposed along the front face, the visual indicators having electrical leads that include rearwardly extending portions and downwardly extending portions; and a retainer latchably secured to the housing and disposed along a rear of the housing, the retainer having apertures and the downwardly extending portions of the leads being disposed in the apertures;

wherein the downwardly extending portions of the leads are installed in the apertures prior to installation of the retainer on the housing, whereby the visual indicators and the retainer comprise a subassembly which is installed on the housing as a unit.

2. The electrical connector of claim 1 wherein the housing has passageways that extend from the rear of the housing to the front face, and the visual indicators are insertable through the passageways.

3. The electrical connector of claim 1 wherein the cavities are arranged in an upper row and a lower row, and the visual indicators of the subassembly are disposed adjacent to the upper row.

4. The electrical connector of claim 3 further comprising visual indicators that are disposed adjacent to the lower row.

5. The electrical connector of claim 4 wherein the cavities of the upper row and the lower row are arranged in vertically aligned pairs, and the visual indicators for each said pair are disposed in a rectangular array with one said visual indicator at each corner of said rectangular array.

6. An electrical connector comprising:

a dielectric housing having a front face and cavities which are open through the front face;

contacts disposed in the cavities;

visual indicators disposed along the front face, the visual indicators having electrical leads that include rearwardly extending portions and downwardly extending portions;

a retainer secured to the housing and disposed along a rear of the housing, the retainer having apertures and the downwardly extending portions of the leads being disposed in the apertures;

wherein the downwardly extending portions of the leads are installed in the apertures prior to installation of the retainer on the housing, whereby the visual indicators and the retainer comprise a subassembly which is installed on the housing as a unit; and a ground shield overlying a top wall of the housing has resilient grounding tabs which are vertically aligned with respective ones of the cavities.

7. An electrical connector comprising:

a dielectric housing having a front face and cavities which are open through the front face;

contacts disposed in the cavities;

visual indicators disposed along the front face, the visual indicators having electrical leads that include rearwardly extending portions and downwardly extending portions; and a retainer secured to the housing and disposed along a rear of the housing, the retainer having a pair of laterally extending ribs and apertures that extend in vertically aligned pairs through each of the ribs, the downwardly extending portions of the leads being disposed in the apertures, wherein at least one of the ribs has upwardly extending projections with surfaces arranged for guiding the leads into the apertures;

wherein the downwardly extending portions of the leads are installed in the apertures prior to installation of the retainer on the housing, whereby the visual indicators and the retainer comprise a subassembly which is installed on the housing as a unit.

8. An electrical connector comprising:

a dielectric housing having a front face and cavities which are open through the front face;

contacts disposed in the cavities;

visual indicators disposed along the front face, the visual indicators having electrical leads that include rearwardly extending portions and downwardly extending portions; and a retainer secured to the housing and disposed along a rear of the housing, the retainer having apertures and the downwardly extending portions of the leads being disposed in the apertures;

wherein the downwardly extending portions of the leads are installed in the apertures prior to installation of the retainer on the housing, whereby the visual indicators and the retainer comprise a subassembly which is installed on the housing as a unit; and wherein the retainer has positioning posts which are received in corresponding holes in the housing.

9. The electrical connector of claim 8 wherein the positioning posts are interference fitted in the holes.

* * * * *